US005409276A

United States Patent [19]

Engasser

[11] Patent Number: 5,409,276

[45] Date of Patent: Apr. 25, 1995

[54] READILY RELEASABLE HASP AND STAPLE

[76] Inventor: George L. Engasser, 34 Birchwood Dr., Rhinebeck, N.Y. 12572

[21] Appl. No.: 170,825

[22] Filed: Dec. 21, 1993

Related U.S. Application Data

[63] Continuation-in-part of Ser. No. 79,874, Jun. 23, 1993, abandoned.

[51] Int. Cl.[6] ..... E05C 19/08

[52] U.S. Cl. ..... 292/281; 292/341.18; 70/2

[58] Field of Search ..... 70/2–14, 70/51, 52, 54–56, 416, 417, 451, 466; 290/281–289, 341.18

[56] References Cited

U.S. PATENT DOCUMENTS

| | | | |
|---|---|---|---|
| 513,667 | 1/1894 | Buckingham | 292/341.18 |
| 513,668 | 1/1894 | Buckingham | 292/281 |
| 702,605 | 6/1902 | Voight | 292/341.18 |
| 722,344 | 3/1903 | Wirt | 292/281 |
| 878,047 | 2/1908 | Darracott | 292/281 |
| 1,222,649 | 4/1917 | Marshall | 292/281 |
| 1,472,512 | 10/1923 | Carlson | 292/281 |
| 1,473,080 | 11/1923 | Collins | 292/282 |
| 1,623,050 | 4/1927 | Frantz | 292/281 |
| 1,690,408 | 11/1928 | Hasenflue | 292/281 X |
| 1,725,657 | 8/1929 | Lessard | 292/281 |
| 1,734,655 | 11/1929 | Turner | 292/281 |
| 1,805,401 | 5/1931 | Janney | 292/281 |
| 1,842,385 | 1/1932 | Boesel | 292/281 |
| 1,951,551 | 3/1934 | Long | 292/281 |
| 1,988,185 | 1/1935 | Borden | 70/13 |
| 2,046,078 | 6/1936 | Marshall | 292/281 |
| 2,790,664 | 4/1957 | Bramley et al. | 292/285 |
| 3,317,230 | 5/1967 | Demrick et al. | 292/281 |
| 3,796,071 | 3/1974 | Crepinsek | 70/32 |
| 3,927,544 | 12/1975 | Klein | 70/416 |
| 4,879,889 | 11/1989 | DeForrest | 292/281 X |
| 4,886,308 | 12/1989 | Bowman | 292/281 |
| 4,938,041 | 7/1990 | O'Gara | 70/33 X |

FOREIGN PATENT DOCUMENTS

| | | | |
|---|---|---|---|
| 65151 | 2/1950 | Netherlands | 292/281 |
| 279611 | 11/1927 | United Kingdom | 292/281 |

OTHER PUBLICATIONS

Popular Mechanics, Aug. 1956, p. 152.

*Primary Examiner*—Peter M. Cuomo
*Assistant Examiner*—Suzanne L. Dino
*Attorney, Agent, or Firm*—Richard C. Litman

[57] ABSTRACT

A closure fastener comprising a hasp and a cooperating staple. The hasp is slidably engageable with a mount and the staple is slidably engageable with another mount. Upon coupling the hasp and the staple and applying a lock thereto, the hasp and the staple are captively retained such that the two are prevented from disengaging from their respective mounts. Alternatively, the hasp and the staple are provided with a hook and the mounts each include a biasing mechanism to bias the hooks into engagement with their respective mounts. In this arrangement, the hasp and the staple must each be intentionally released from their respective mounts. In each embodiment, a stop mechanism is provided to limit the travel of tongue and the base through their respective mounts. The hasp and staple can be formed made from sheet metal blanks. The mount for the staple and hasp can be formed as a universal mount from a zigzag shaped sheet metal blank. The staple can be formed from a U-shaped sheet metal blank. All the parts of the closure fastener can be stamped or cast from plastic or metal or forged from metallic material.

20 Claims, 9 Drawing Sheets

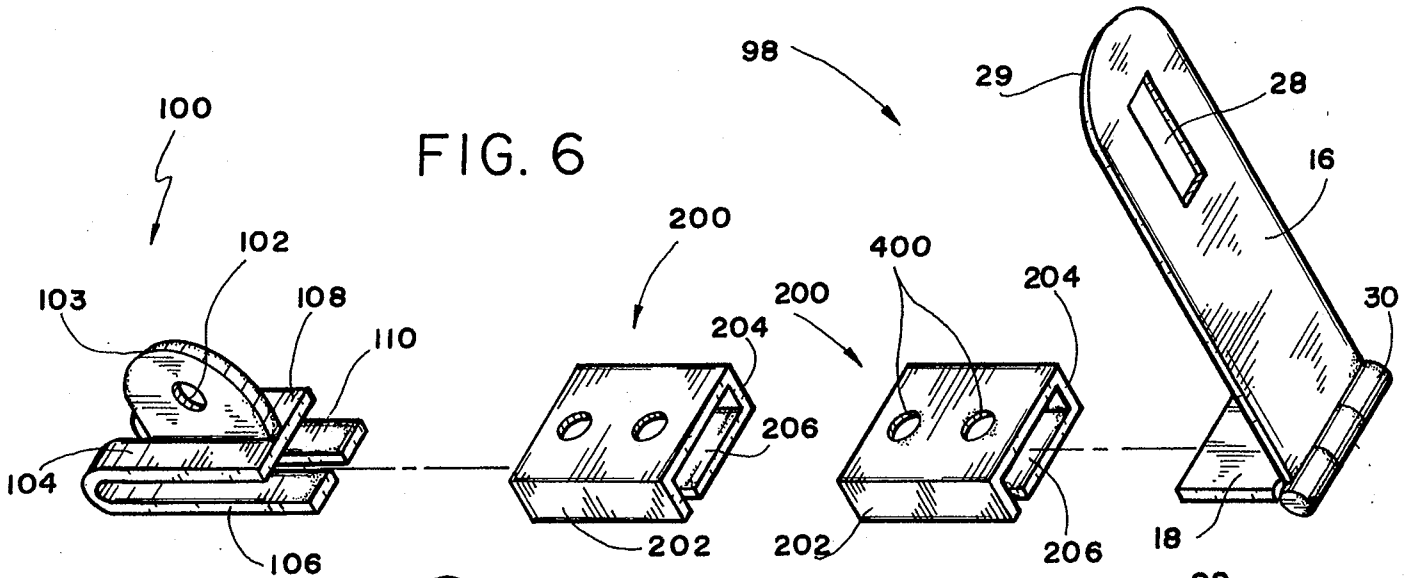
FIG. 6
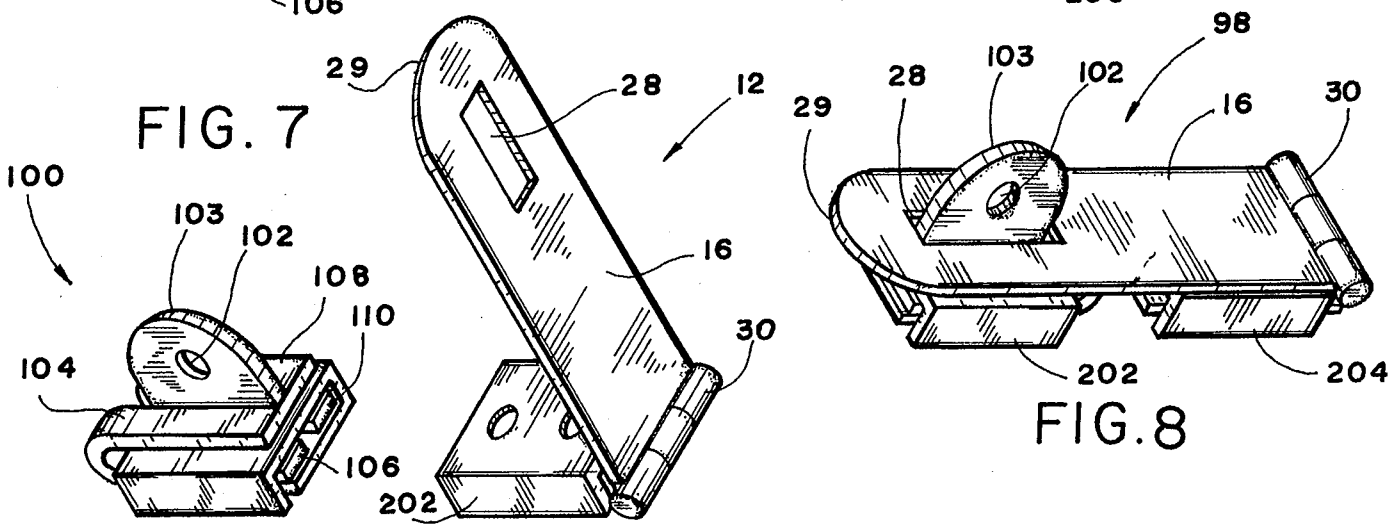
FIG. 8
FIG. 7

FIG. 11A
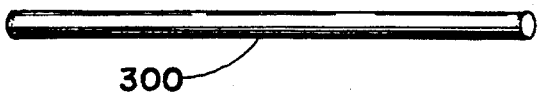
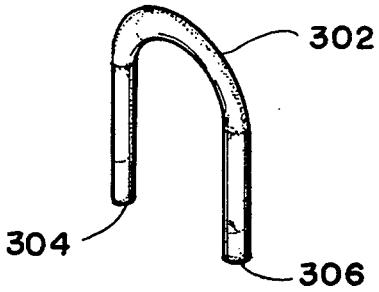
FIG. 11B
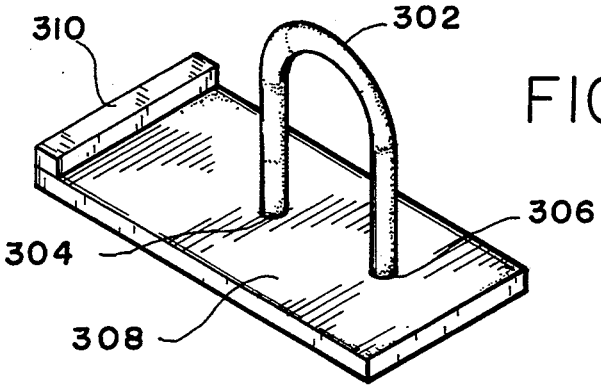
FIG. 12
FIG. 13
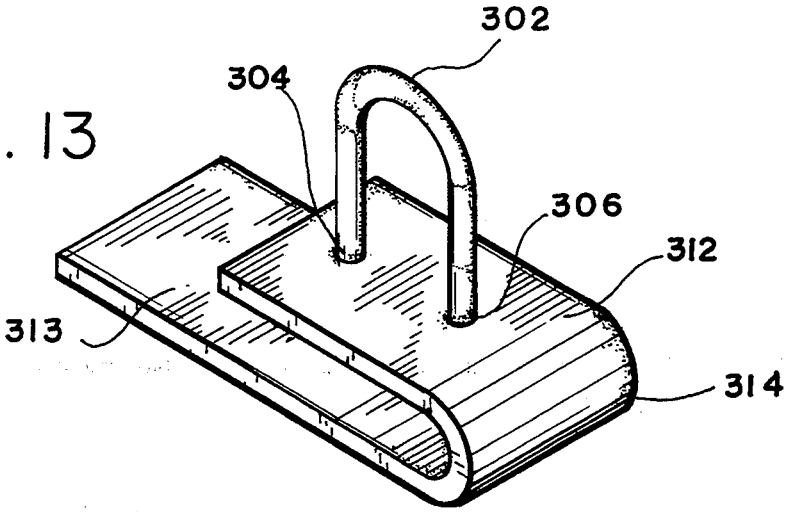

READILY RELEASABLE HASP AND STAPLE

This is a continuation-in-part of application Ser. No. 08/079,874, filed Jun. 23, 1993, and now abandoned.

BACKGROUND OF THE INVENTION

1. Field of the Invention

The present invention relates to closure fasteners and more particularly, to a slidably removable hasp and staple wherein both the hasp and the clasp can be completely removed from the closure fastener when the fastener is in an open condition.

2. Description of the Prior Art

Closure fasteners are known in numerous forms, one of the most common being a hasp and a cooperating staple. For example, U.S. Pat. No. 702,605, issued Jun. 17, 1902 to August Voight, and U.S. Pat. No. 2,046,078, issued Jun. 30, 1936 to William H. Marshall, each show a conventional hasp and matingly engageable staple fixedly attachable to a door and threshold, respectively. A problem associated with the hasp and staple is as follows: when not in use, the hasp moves freely to extend transversely from its respective mounting surface and the staple extends rigidly from its respective mounting surface, both of which present potential harm to persons in the proximity of the same.

A combination hasp and staple which are readily removable from their respective mounting surfaces could reduce the risk of harm which may otherwise be present in the vicinity of a hasp and staple in an uncoupled condition. Applicant proposes a hasp and staple which slidably engage fixed mounts such that the two are captively retained when they are coupled to support a lock and which slidably disengage so as to be stored when uncoupled. U.S. Pat. No. 513,667, issued Jan. 30, 1894 to John L. Buckingham, discloses a sliding staple for hasps comprising a housing or a support provided with a longitudinal slot through which the staple is designed to project and slide freely. The staple is carried by a plate which is of sufficient width to extend under the upper or outer wall of the support to restrict its displacement along a longitudinal axis. U.S. Pat. No. 513,668, issued Jan. 30, 1894, also to John L. Buckingham, discloses a hasp having a first portion provided with holes for receiving screws. Opposite sides of the first portion are provided with flanges for cooperatively receiving a second portion. A pin protrudes from the first portion which engages and moves freely in a first slot in the second portion. A second slot is provided for the reception of the staple. Unlike applicant's instant invention, to be described hereinafter, the aforementioned staple and hasp disclosed by Buckingham are displaceable to compensate for the expansion and contraction of the structure in which the same are applied. Neither the staple nor the hasp may be readily removed.

A closure fastener of the hasp and staple type, wherein the hasp can be readily removed, are shown in U.S. Pat. No. 3,317,230, issued May 2, 1967 to Raymond R. Demrick et al., U.S. Pat. No. 3,927,544, issued Dec. 23, 1975 to Jack Klein, and Netherlands Pat. No. 65,151, issued Feb. 15, 1950 to Eras.

A closure fastener of the hasp and staple type wherein the staple can be readily removed is shown in U.S. Pat. No. 1,473,080, issued Nov. 6, 1923 to Calhoun Collins.

Alternative forms of a hasp and staple are shown in U.S. Pat. No. 4,403,799, issued Sep. 13, 1983 to Robert S. Kafka et al., and U.S. Pat. No. 4,316,626, issued Feb. 23, 1982 also to Robert S. Kafka et al., each of which disclose a flush mount hasp rigidly attached to a door. The hasp extends beyond the door edge to cooperatively engage a foldable, upstanding staple. The staple is rigidly attached to the door jam adjacent to the door. Because the hasp is rigidly attached to the latch so as to extend beyond the edge thereof, it is inclined to subject individuals to potential injury, especially when the door is not in a closed position. The rigid attachment of the hasp to the door clearly appears to present a greater risk of injury when the hasp and the staple are uncoupled and the door is in an opened position.

Another form of clasp and hasp fastener is shown in U. S. Pat. No. 3,796,071, issued Mar. 12, 1974 to Alois Crepinsek, showing a clasp 33 slidably cooperating with a hasp 30 and covering same when closed. The Crepinsek clasp, as shown in FIGS. 9 and 10, has smoothly rounded edges to minimize injuries.

Fasteners of the hasp and staple type formed from sheet metal are shown in U.S. Pat. No. 1,623,050, issued Apr. 5, 1927 to Peter Frantz, U.S. Pat. No. 1,805,401, issued May 12, 1931 to Edward K. Janney, and U.S. Pat. No. 2,790,664, issued Apr. 30, 1957 to Benjamin E. Bramley et al.

Hasp and staple type fasteners having pivotally mounted sheet metal hasps are shown in U.S. Pat. 722,344, issued Mar. 10, 1903 to Reuben D. Wirt, U.S. Pat. No. 1,222,649, issued Apr. 17, 1917 to Ianthus E. Marshall, U.S. Pat. No. 1,734,655, issued Nov. 5, 1929 to Eugene C. Turner, and U.S. Pat. No. 1,988,185, issued Jan. 15, 1935 to Henry M. Borden.

Further known fasteners of the hasp and staple type having sheet metal locking springs as shown in U.S. Pat. No. 878,047, issued Feb. 4, 1908 to George F. Darracott, U.S. Pat. No. 1,842,385, issued Jan. 26, 1932 to Otto A. Boesel, British Pat. No. 279,611, issued Nov. 3, 1927 to Skeldings et al., and on page 152 of a Popular Mechanics Publication, published August, 1956, in an article titled, "Self Locking of Hasp Prevented".

Applicant's instant invention would be ideal for use in areas involving tight quarters, such as in trailers and in boats, and would truly be advantageous for use on structures positioned at eye level, such as cabinets and the like. None of the above patents, taken either singly or in combination, is seen to describe the instant invention as claimed.

SUMMARY OF THE INVENTION

The present invention is a closure fastener comprising a hasp assembly and a cooperating staple assembly. The closure fastener may be formed from plastic, metal, metal alloy or a combination thereof. All of the parts of the closure fastener can be stamped, forged or cast from suitable material. Stainless steel is preferred since it is tough, presents a pleasing appearance, and resists chemical attack. However, carbon steel which has a protective coating of rust preventing material such as thermoplastic, rubber, enamel, or an electroplated nobel metal (i.e. silver, gold, and platinum) can be employed. A suitable alloy is bronze (i.e. an alloy of copper and tin). Also suitable plastic which can be molded, extruded, or cast in suitable form can be employed. Polyethylene and polypropylene are preferred materials which can be easily extruded. Polycarbonate plastic is a preferred molded plastic material. Metal and plastic components made from sintered powder technology can also be employed. Austenitic steel noted for extreme hardness can further be employed. The material employed is of suitable thickness to resist breaking under normal use. The hasp assembly includes a hasp which slidably engages a hasp mount via a tongue pivotally attached to the hasp. The staple assembly includes a staple rigidly attached to a base which slidably engages a staple mount. Upon coupling the hasp and the staple, and applying a lock to the staple, the tongue and the base are captively retained such that the two are prevented from being removed from their respective mounts until the lock is removed, and the hasp and staple are uncoupled. The same mount may be used for the staple and the hasp. This mount is formed from a single piece of sheet metal suitably bent into a channel-like shape. The hasp mount and the staple mount are rigidly secured to adjacent portions of a door and a door frame. The mounts may be of closed box-like configuration to present smooth edges to prevent any inadvertent snagging of the edges thereof by a person when installing the mounts or when passing by the installed mounts. As an alternative, the tongue and the base may be provided with a hook and their respective mounts may each include a biasing mechanism to bias the hooks into engagement therewith. In this embodiment, the tongue and the base each must be intentionally released regardless of whether the hasp and staple are coupled. As a further alternative, the staple may be formed from a single U-shaped piece of sheet metal which has been suitably bent upon itself to form an integral staple with a pair of tabs joined back to back, the tabs being apertured to receive a shank of a padlock therethrough. The staple also has a front base from which the tabs extend and which is integrally joined to a back base by a curved bight portion. The bases are of unequal lengths. The back base is longer than the front base. The back base is adapted to slidably engage within a mount to releasably fasten the staple thereto. The curved bight portion of the staple prevents the staple from being removed from the mount when a padlock is in place within the apertures in the tabs to lock the staple and an associated hasp of the fastener together. Yet another embodiment of the staple is formed from a piece of stiff wire which has been bent into a U-shape having a bight portion for engagement with an associated pivoted hasp and shank of a padlock. The wire staple has a pair of free ends which are fixedly secured to an associated J-shaped base having a bight portion and parallel leg portions of unequal lengths. Metallic welding, brazing, and soldering can be employed to fixedly secure the free ends of a metallic wire staple to a metallic base. Ultra sonic welding can be employed to fixedly secure the staple and the base together when the wire staple and base are formed of plastic.

Accordingly, it is a principal object to provide a closure fastener comprising a hasp and staple which are readily removable from their respective mounting surfaces.

It is another object that the hasp and staple slidably engage respective mounts during attachment to and detachment therefrom.

It is a further object that the hasp have a tongue pivotally attached thereto and the staple have a base attached thereto, wherein the tongue and the base slidably engage their respective mounts.

Still another object is that upon coupling the hasp and the staple and applying a lock to the staple, the hasp and the staple are captively retained such that the two are prevented from being removed from their respective mounts.

Yet another object is to provide a closure fastener in which the hasp and the base each include a hook, and their respective mounts each include a biasing mechanism to bias the hooks into engagement with their respective mounts, whereupon the hasp and the staple must each be intentionally released from their mounts regardless as to whether the hasp and staple are coupled together.

Another object of the invention is to provide a universal mount which can be employed to mount both a staple and a hasp of a closure fastener in a slidable readily releasable manner.

Still another object of the invention is to provide a channel-like universal mount for a hasp and a staple of a closure fastener which is formed from bent sheet metal.

Yet another object of the invention is to provide a universal mount for a closure fastener which, when mounted, has smooth external edges to prevent snagging of an article thereon.

Another object of the invention is to provide a universal mount for a fastener which is formed from a zigzag piece of flexible sheet metal having an elongated base with opposed tabs extending from opposite sides thereof in a staggered manner so that one tab forms a lower back portion of the mount and the other tab forms an upper back portion of the mount. The tabs are apertured to receive fasteners therethrough and have sufficient flexibility so that the mount can be fastened on an uneven surface.

A further object of the invention is to provide a hasp which has a pivotally mounted tongue which slidably engages within a universal mount to removably retain the hasp in a desired position.

Yet another object of the invention is to provide a hasp wherein the hasp has a tongue which is of greater length than an associated mount so that the hasp cannot be removed from the associated mount when securely fastened to an associated staple.

A further object of the invention is to provide a staple of a closure fastener wherein the staple is integrally formed from a U-shaped sheet of bendable sheet metal.

Still another object of the invention is to provide a staple of a closure fastener wherein the staple has a pair of tabs integrally joined in back to back relation and each tab is provided with opposed aligned apertures of sufficient size to receive a shackle of a padlock therethrough.

Another object of the invention is to provide a staple of a closure fastener wherein the staple has an apertured tab projecting from a front base portion which is integrally joined to a rear base portion in a hook-like manner.

Yet another object of the invention is to provide a staple of a closure fastener wherein the staple has a base which slidably engages within an associated mount and has greater length than the mount so that the staple cannot be removed from the mount when it is locked within an associated hasp by a padlock.

Still another object of the invention is to provide a staple of a closure fastener wherein the staple has a pair of bases of unequal lengths joined by a smoothly curved bight portion.

Another object of the invention is to provide a staple of a closure fastener wherein the staple has a base portion which has a pair of spaced flexible tabs which slidably and frictionally engage edge portions of an associated mount so that the staple can be retained at a desired position relative to the associated mount.

Yet another object of the invention is to provide a universal mount for a closure fastener wherein the mount has a base which is provided with openings therein to accommodate fasteners to securely fasten the mount to an associated surface of a door and door jamb of a cabinet, such as a school locker.

Another object of the invention is to provide a closure fastener fabricated from bendable stainless steel.

A further object of the invention is to provide a closure fastener fabricated from plastic material.

Yet a still further object of the invention is to provide a closure fastener fabricated from parts which can all be stamped, forged or cast.

Another object of the invention is to provide a closure fastener fabricated from parts which can all be stamped, forged or cast from metallic material.

A still further object of the invention is to provide a closure fastener fabricated in part from plastic material and in part from metallic material.

Still another object of the invention is to provide a mount for a closure fastener wherein the mount has a plurality of openings therein on opposite faces thereof, one set of openings being of sufficient size to receive a shank of a screwdriver therein, and the other set of openings being of sufficient size to snugly receive mounting screws therethrough.

A further object of the invention is to provide a mount for a closure fastener wherein the mount has openings therein to accommodate screw fasteners having convex heads, the openings being concave so that screw heads will fit flush.

It is an object of the invention to provide improved elements and arrangements thereof in an apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

FIG. 6 is an exploded perspective view of a hasp and cooperating staple according to a third mode of the present invention.

FIG. 7 is a perspective view of the hasp and staple shown in FIG. 6 in open condition.

FIG. 8 is a perspective view of the hasp and staple shown in FIG. 6 in a closed condition.

FIG. 11A is a perspective view of a piece of wire used to form a hoop of a staple.

FIG. 11B is a perspective view of the wire of FIG. 11A when formed into a hoop of a staple.

FIG. 12 is a perspective view of the wire hoop of FIG. 11A attached to a flat base to form a staple.

FIG. 13 is a perspective view of a wire hoop of FIG. 11A attached to a J-shaped base to form a staple.

Similar reference characters denote corresponding features consistently throughout the attached drawings.

DETAILED DESCRIPTION OF THE PREFERRED EMBODIMENTS

Figure 1:
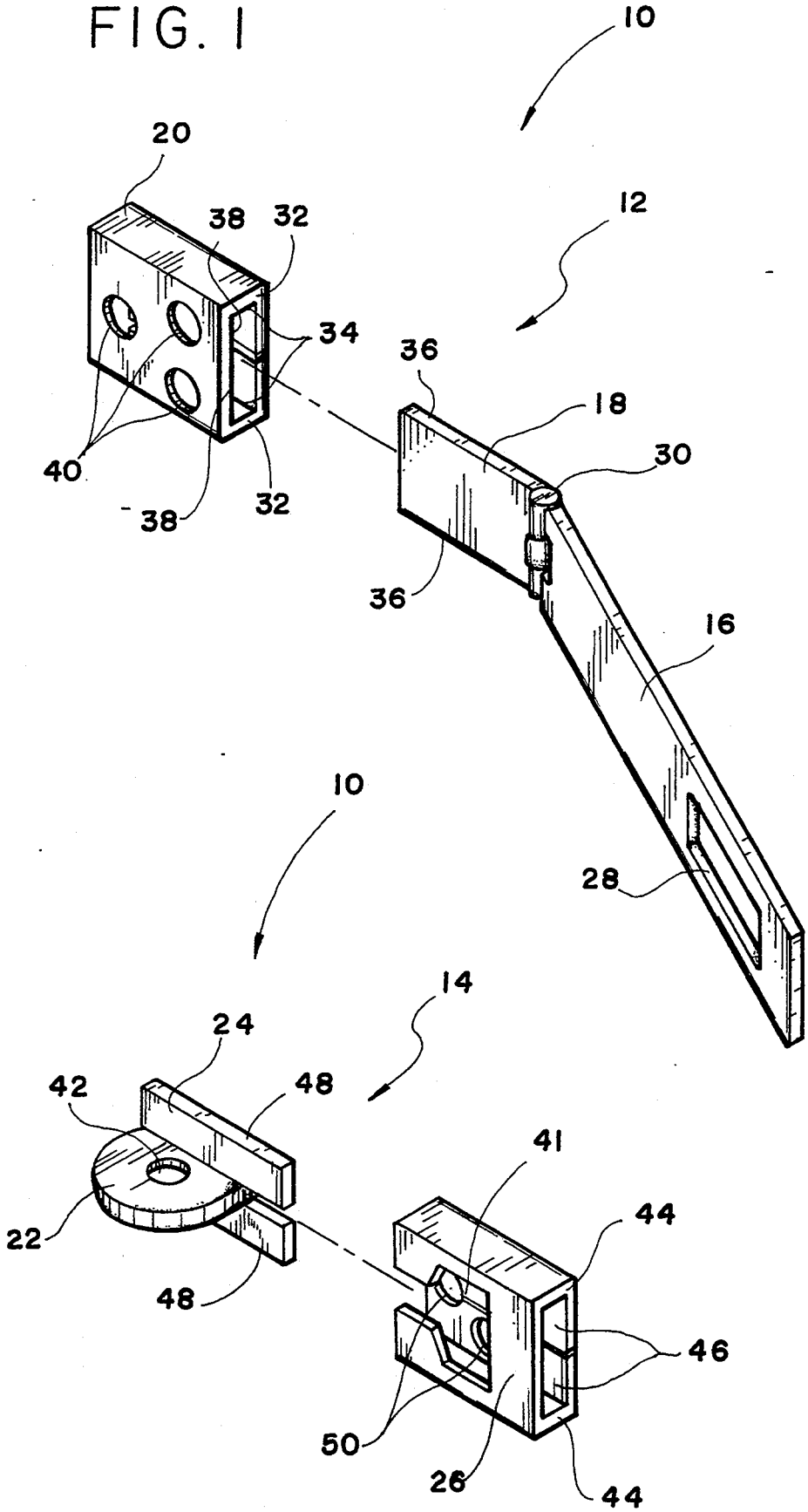
FIG. 1 is an exploded perspective view of a hasp and cooperating staple according to a first mode of the present invention.
Figure 2:
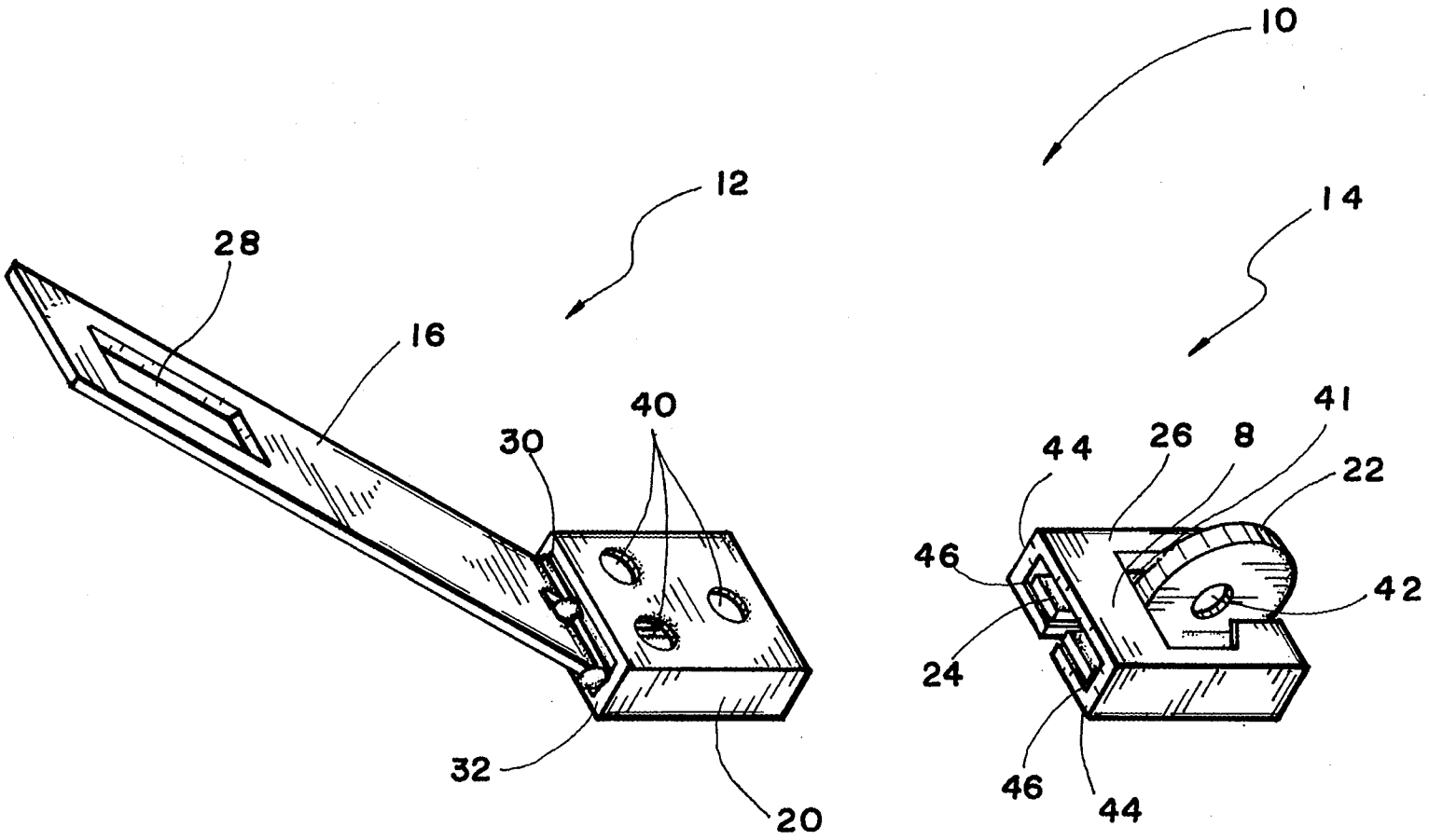
FIG. 2 is a perspective view of the hasp and staple shown in FIG. 1.
Figure 3:
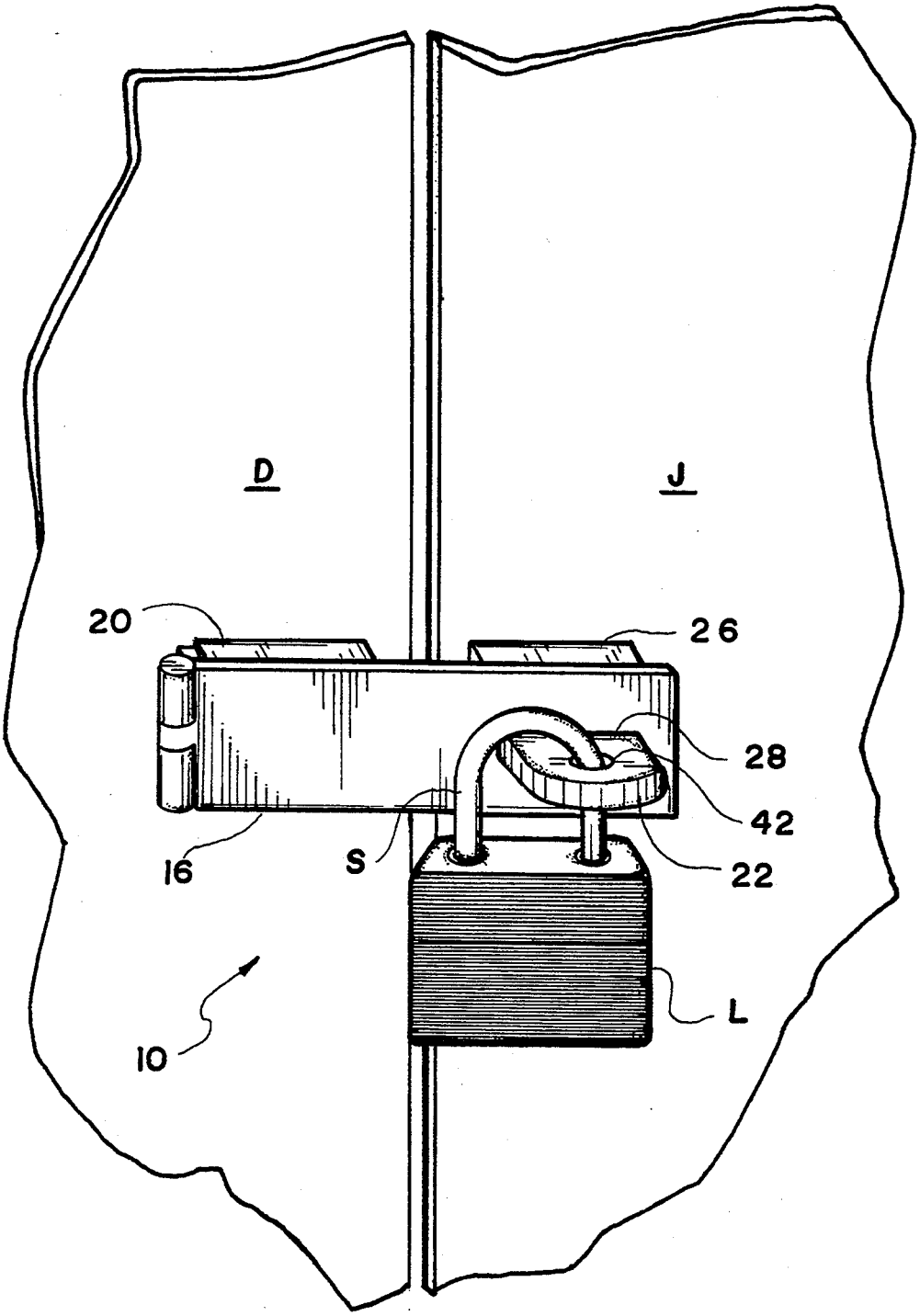
FIG. 3 is an environmental perspective view of the hasp and staple shown in FIG. 2.

The first embodiment of the present invention, as shown in FIGS. 1 through 3, is a closure fastener 10 preferably fabricated substantially of plastic, metal or a metal alloy. A suitable metal for forming the closure fastener is stainless steel. The fastener 10 comprises a hasp assembly 12 and a cooperating staple assembly 14. The hasp assembly 12 includes a hasp 16, a tongue 18 pivotally attached to a pivotal end of the hasp 16, and a hasp mount 20 for releasably receiving the tongue 18. The staple assembly 14 includes a staple 22, a base 24 rigidly attached to staple 22, and a staple mount 26 for releasably receiving the base 24.

The hasp 16 is a substantially rectangular planar member having a slot 28 longitudinally disposed in a locking end thereof, the locking end being located opposite the pivotal end. The slot 28 facilitates in receiving the staple 22 therethrough when the hasp and staple assemblies 12, 14 are cooperatively engaging one another. The dimensions of the hasp 16 are dependent on the structure (shown in FIG. 3) to which it is attached.

The tongue 18 is a substantially rectangular planar member. The dimensions of the tongue 18 are such that the tongue 18 slidably engages the hasp mount 20. The tongue 18 is pivotally attached to the pivotal end of the hasp 16 via a hinge linkage 30. The hinge linkage 30 is offset to permit the hasp 16 to close flush against the hasp mount 20 upon engagement of the hasp and staple assemblies 12, 14.

The hasp mount 20 is comprised of a planar panel having inwardly directed folds 32 along the opposing longitudinal sides thereof. Oppositely disposed channels 34 are bounded by the folds 32. The channels 34 cooperatively receive the longitudinal sides 36 of the tongue 18. The hasp mount 20 further includes a plurality of bores 38, shown more clearly in FIGS. 4 and 5, the bores 38 preferably being countersunk. Each bore 38 accommodates a threadable fastener 52, as shown in FIG. 5, for rigidly attaching the hasp mount 20 to a supporting surface D (shown in FIG. 3). Bores 40 are also provided in the top or the exposed surface of the hasp mount 20 which provide access to the bores 38 in the bottom of the hasp mount 20 to permit the fasteners 52 to be applied through the bores 38 in the bottom of the hasp mount 20.

The staple 22 is shown as a substantially U-shaped member attached integrally to the base 24. It should be understood that a substantially square piece of stock having an aperture therein may be employed in the place of the U-shaped member. The staple 22 may be forged from metallic material or stamped or cast from plastic or metallic material. The staple 22 includes an aperture 42 passing therethrough providing a passage for a shackle of a lock L, as shown in FIG. 3.

Similar to the hasp mount 20, the staple mount 26 is comprised of a planar panel having inwardly directed folds 44 along the opposing longitudinal sides thereof. Oppositely disposed channels 46 are bounded by the folds 44. The channels 46 cooperatively receive the longitudinal sides 48 of the base 24. The staple mount 26 also includes a plurality of bores 50 for accommodating threadable fasteners 52 (shown in FIG. 5) for rigidly attaching the staple mount 26 to its respective supporting surface J (shown in FIG. 3). An opening 41 is provided in the top or the exposed surface of the staple mount 26 which provides access to the bores 50 in the bottom of the staple mount 26 to permit the fasteners 52 to be applied through the bores 50.

As shown in FIGS. 1 and 2, the tongue 18 slidably engages the hasp mount 20 and the base 24 slidably engages the staple mount 26. The staple mount 26 includes a laterally extending member 8 which facilitates in limiting the travel of the base 24 of the staple assembly 14 therethrough.

In use, as is shown in FIG. 3, the hasp mount 20 is mounted to a movable portion D, such as a door of a structure to which it is secured, and the staple mount 26 is mounted to a stationary portion J, such as a door jam of the structure to which it is secured, or vice versa. The tongue 18 of the hasp assembly 12 is slidably inserted into the hasp mount 20 and the base 24 of the staple assembly 14 is slidably inserted into the staple mount 26. The hasp 16 is pivotally displacable to permit the staple 22 to be received by the slot 28. The shackle S of a lock L is passed through the aperture 42 in the staple 22 to maintain the same in engagement with the hasp 16. With the lock L applied, the tongue 18 and the base 24 are captively retained, that is to say, prevented from being removed from their respective mounts 20, 26, and the fasteners 52, as shown in FIG. 5, are inaccessible.

Figure 4:
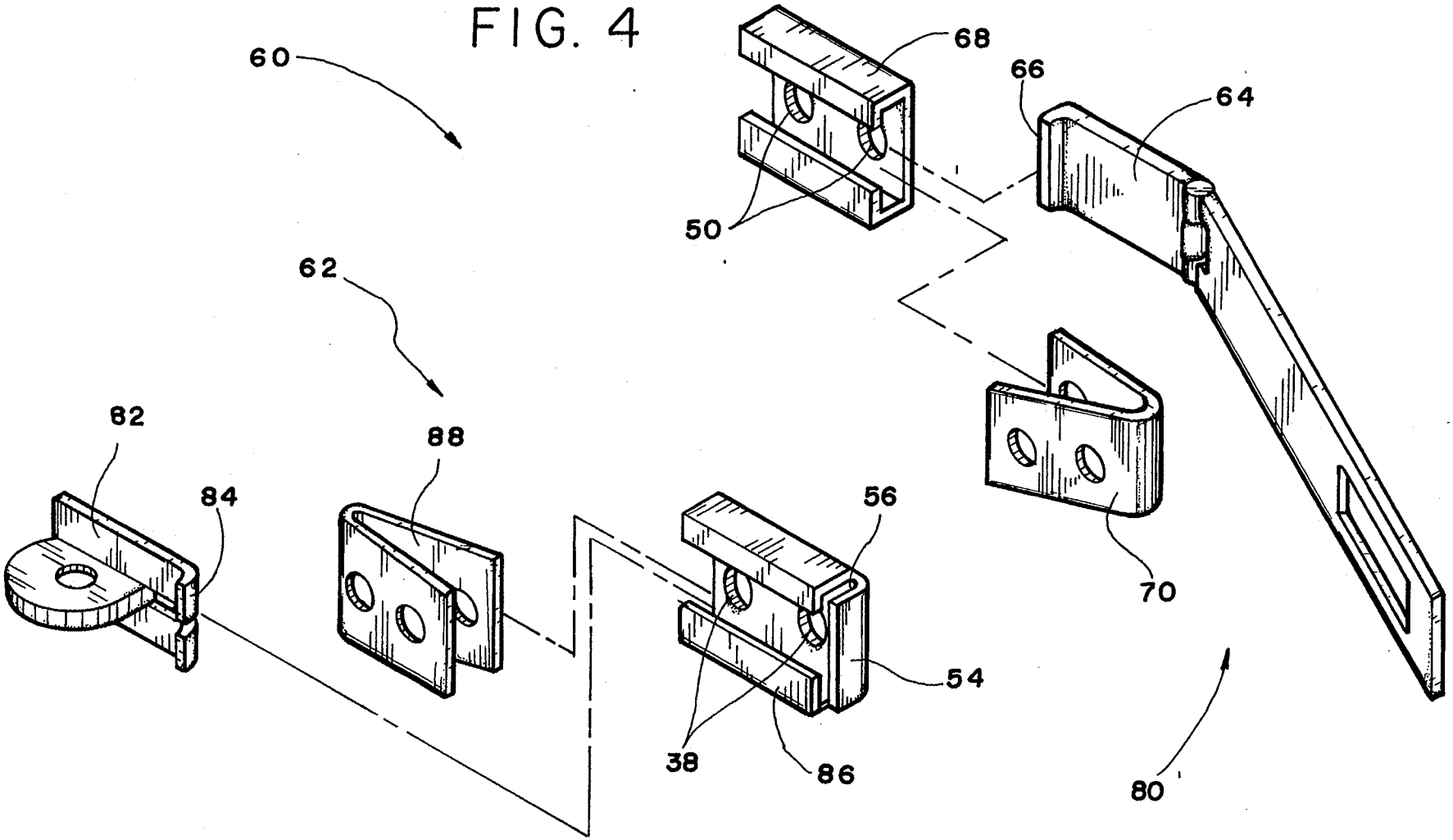
FIG. 4 is an exploded perspective view of an alternative hasp and cooperating staple according to a second mode of the present invention.
Figure 5:
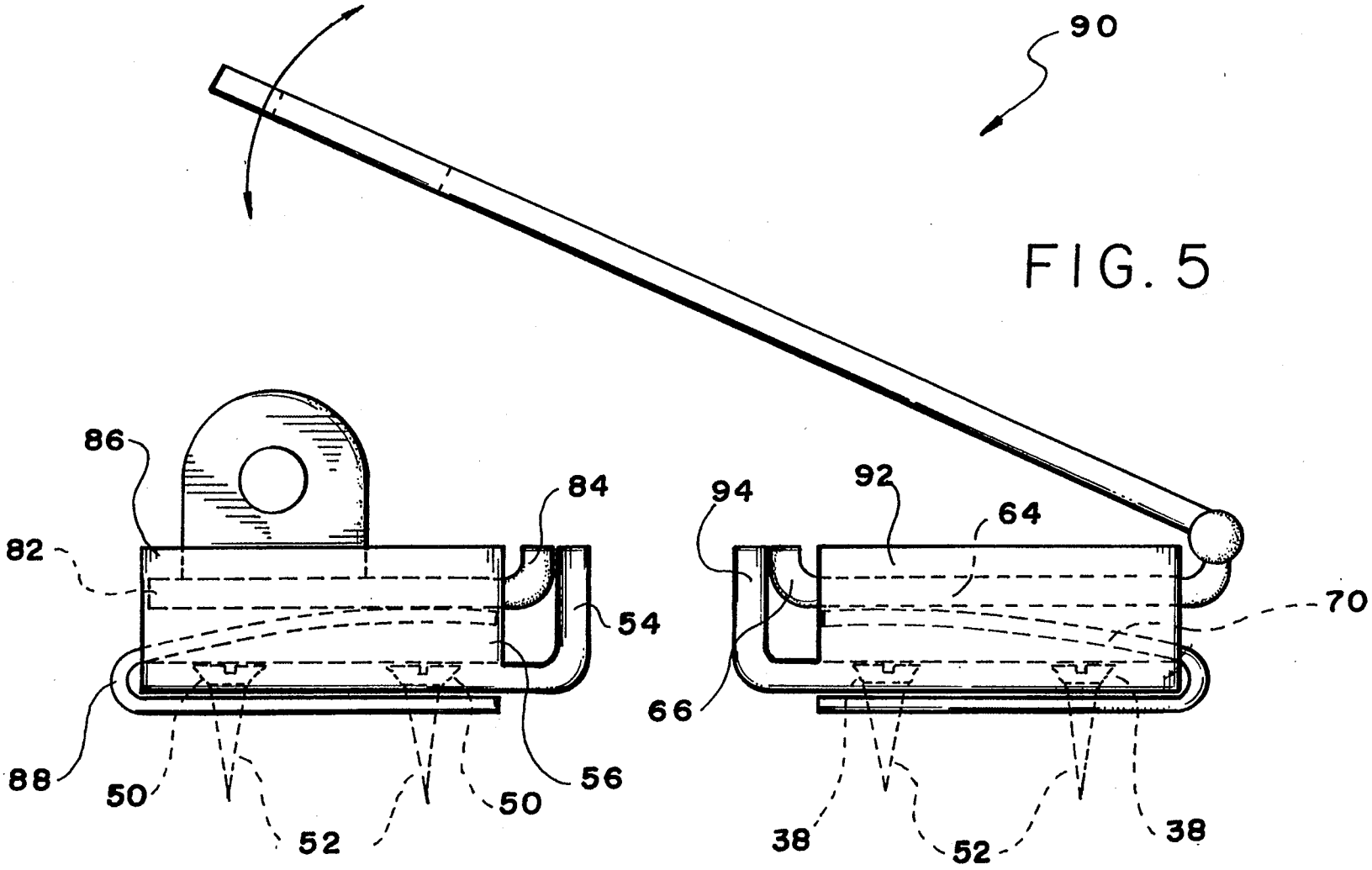
FIG. 5 is a side elevational view of the hasp and staple shown in FIG. 4.

Alternative embodiments of the closure fasteners 60, 90 are shown in FIGS. 4 and 5. The hasp assembly 62 of one of the alternative closure fasteners 60, as shown in particular in FIG. 4, includes a tongue 64 having a hook 66 which engages the terminal end of the hasp mount 68. The hook 66 is formed integrally with the tongue 64 by bending the lateral edge of the leading end of the tongue 64 so as to permit the inside corner of the bend to engage the terminal end of the hasp mount 68. The hasp mount 68 includes a piece of spring material 70 formed from plastic or metal which applies a biasing force against the tongue 64. Upon engaging the tongue 64 with the hasp mount 68, the hook 66 is biased against the interior wall of the passage through the hasp mount 68. At the juncture where the hook 66 exits the passage through the terminal end of the hasp mount 68, the tongue 64 is biased such that the hook 66 engages the terminal end of the hasp mount 68. The hook 66 retains the tongue 64 in engagement with the hasp mount 68 until the tongue 64 is intentionally released. The tongue 64 may be released simply by applying a force against the tongue 64 in opposition to the force of the spring material 70 which, in turn, displaces the hook 66 out of engagement with the terminal end of the hasp mount 68, enabling the tongue 64 to be slidably released from the hasp mount 68.

Similar to the hasp assembly 62, the staple assembly 80 includes a base 82 having a hook 84 which engages the terminal end of the staple mount 86. The staple mount 86 includes a piece of spring material 88 formed from plastic or metal which applies a biasing force against the hook 84 to engage the hook 84 with the terminal end of the staple mount 86. The base 82 may be released by applying a force against the base 82 in opposition to the biasing force of the piece of spring material 88, in turn, displacing the hook 84 and enabling the base 82 to be released from the staple mount 86.

The staple mount 86 further includes a stop 54 extending beyond its terminal end for limiting the travel of the base 82 relative to the staple mount 86. The stop 54 is formed from a cantilevered portion of the planar panel which forms the staple mount 86. The cantilevered portion is bent so as to extend parallel to and a predetermined distance from the opening 56 at the terminal end of the staple mount 86. The travel of the base 82 relative to the staple mount 86 is limited through the contact of the leading end of the base 82 with the stop 54. The hasp mount 92 of the other alternative closure fastener 90, as shown in FIG. 5, may also be provided with a similar stop 94 extending beyond its terminal end for limiting the travel of the tongue 64 relative to the hasp mount 92.

Additional alternative embodiments of the closure fasteners 60,90 are shown in FIGS. 6 to 10. The hasp assembly 98 shown in FIGS. 6 to 8 includes a tongue 18 pivotally secured to front plate 16. The pivot connection is shown at 30 and includes a non-removable pintle pin and associated pintles integrally formed on the tongue 18 and associated plate 16. The tongue 18 is formed of greater length than an associated hasp mount 200 so that the hasp cannot be removed from the hasp mount when the closure fastener is fastened by a conventional padlock of the type shown at L in FIG.3. Tongue 16 has an elongated slot 28 therein for reception of prong 103 of an associated staple and has a rounded edge 29 as shown in FIGS. 6 and 7, to facilitate gripping thereof by the fingers of a user.

Figure 10B:
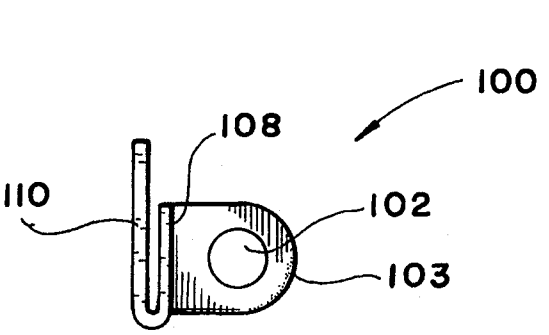
FIG. 10B a left side elevational view of the staple of FIG. 10A.
Figure 10D:
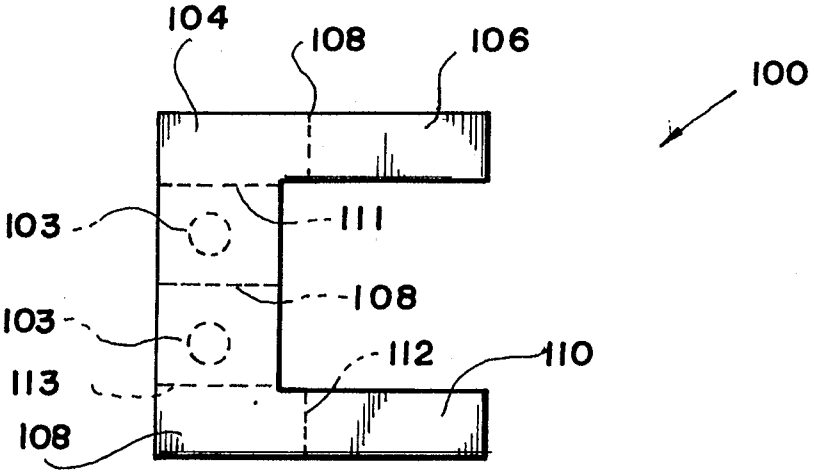
FIG. 10D is a top plan view of the blank from which the staple of FIG. 10C is formed.
Figure 10A:
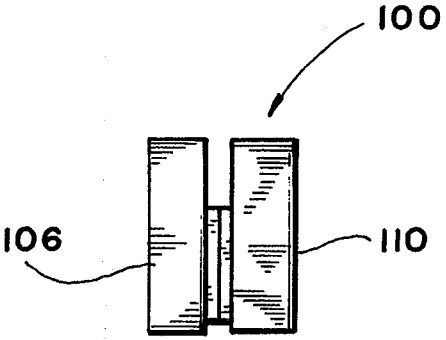
FIG. 10A ms a rear view of a staple of the invention.
Figure 10C:
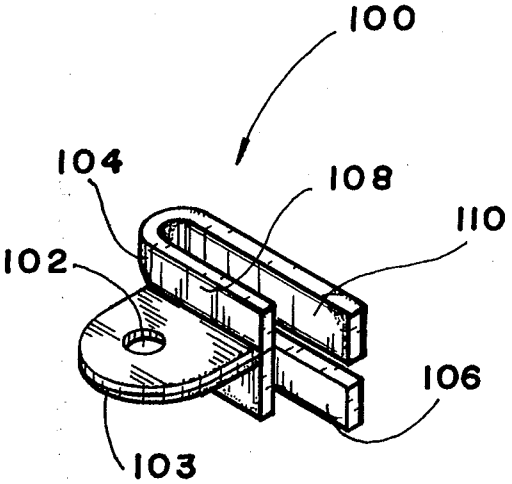
FIG. 10C is a perspective view of the staple.

The staple assembly 100 shown in FIGS. 6 to 8 and 10A–D is formed from a sheet metal blank of stainless steel (FIG. 10D) and includes a prong 103 with an opening 102 therein of sufficient size to receive a shackle of a padlock. As shown in FIG. 10D the sheet metal blank is generally U-shaped and has a central bend portion 109 which when bent outwardly from the plane of the blank at the lateral bend portions 111 and 113 forms a tongue 103 engageable within slot 28, as shown in FIG. 8. The staple 100 has bend portions 107 and 112, as shown in FIG. 10D, which when bent into the plane of the blank form a pair of tabs 106 and 110 which underlie portions 104 and 108 of the staple. Tabs 106 and 110 are of a greater length than associated portions 104 and 108 of mount 200 (FIGS. 6 and 7) to prevent the staple 100 from being removed from an associated mount 200 when the staple 100 is secured in a fastened condition by an associated padlock. Tabs 106 and 110 are spaced slightly from each other, and the outside edges of these tabs slidably and frictionally bear against opposed inside surfaces of the channel formed by edges 202 and 204 of associated mount 200. All bends are arcuately made so as to have smooth external surfaces to prevent injury to a person installing the closure fastener.

Figure 9C:
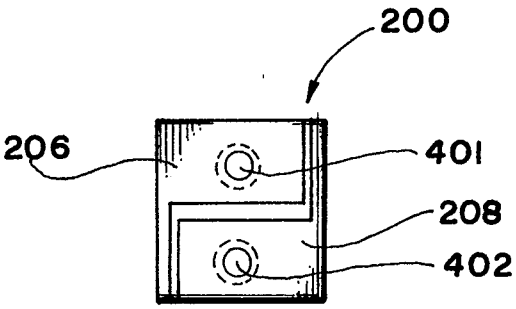
FIG. 9C is a back view of the universal mount of FIG. 9B showing the tabs which are bent to form the back of the mount.
Figure 9B:
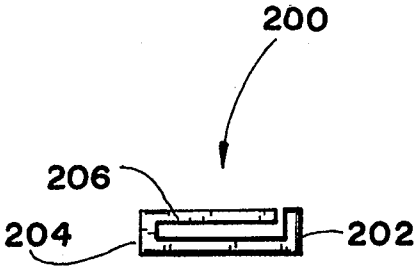
FIG. 9B is a top view of the universal mount of FIG. 9A.
Figure 9A:
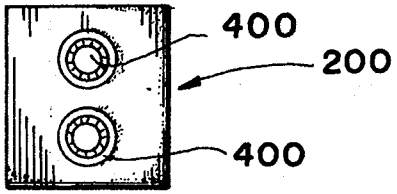
FIG. 9A is a front view of a universal mount for both the hasp and the staple.
Figure 9E:
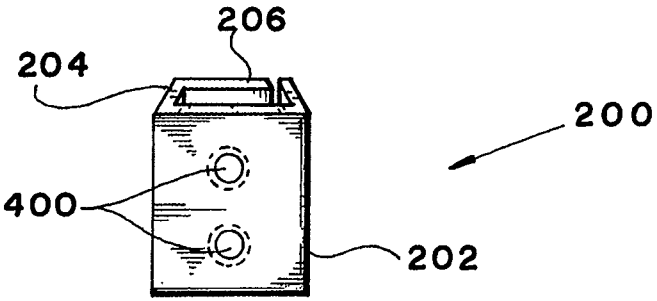
FIG. 9E is a perspective view of the universal mount formed from the blank of FIG. 9D.
Figure 9D:
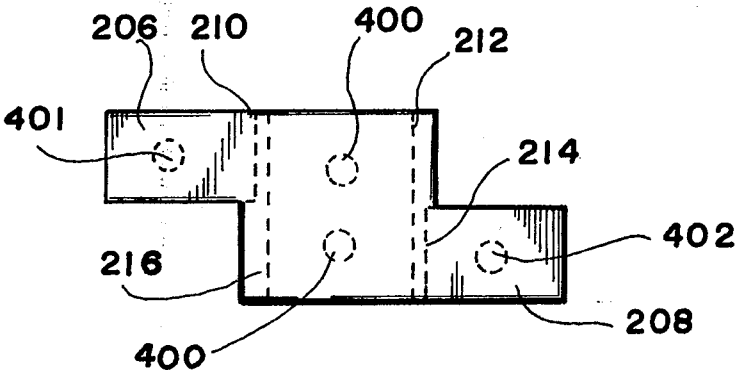
FIG. 9D s a top plan view of the blank from which the universal mount of FIG. 9B is formed.

The mount 200 for the staple 100 and clasp 98 is formed from a bendable sheet metal blank as shown in FIG. 9D. Dotted lines 210 and 212 indicate where the blank is bent to form an open channel with side walls 202 and 204. The blank is of generally zigzag configuration with a front portion having openings 400 therein and opposed staggered tabs 206 and 208 which when bent into the plane of the blank form the back of the mount 200. The opposed staggered positions of tabs 206 and 208 wherein these tabs 206 and 208 extend integrally from opposite edges 204 and 202 of the mount 200, as clearly shown in FIGS. 9C and 9D, precludes a thief from using a tool (such as a screw driver or crow bar) to peel back edges 202 of mounts 200 and ripping a fastened closure fastener off a surface of a structure to which it is attached to pilfer the contents therein. Openings 400 are of sufficient size so as to readily accommodate the shank of a screw driver (not shown) so that a screw driver can readily be employed to drive fastening screws (not shown) extending through openings 401 and 402 formed in tabs 206 and 208. The surface of the openings 401 and 402 associated with a fastening screw are concave to accommodate a convex head formed on the screw so that the fastening screw heads will be flush with tabs 206 and 208. Scoring of the sheet metal blanks can be used to indicate the locations where the blanks are bent and the apertures are punched out and to facilitate bending and punching of the sheet metal in such a manner as to leave smooth surfaces on the exterior thereof.

An alternative method of forming the staple hoop is shown in FIGS. 11A and 11B. A length of straight wire 300 of suitable stiffness is bent at its midpoint to form a hoop 302 of a staple to form an open bight with generally parallel legs which terminate in free ends 304 and 306. Wire 300 can be of bendable plastic or metal, Suitable materials are polypropylene, copper, and steel. A protective rubber coating (not shown) can be applied over the wire 300 to prevent chemical reaction such as oxidation (i.e. rusting) of a metal wire. The rubber coating when applied will also provide a soft, smooth surface to prevent injury to a person handling the staple and prevent a metallic staple from making a clinking sound when carried with coins in a pocket of a user.

Additional alternative embodiments of the staple for the closure fastener are shown in FIGS. 12 and 13. Wire hoop 302 is fixedly attached at free ends 304 and 306 to a suitable base 308 in FIG. 12 and 312 in FIG. 13 to form a closed hoop for reception of a hasp thereover and a padlock therethrough as shown in FIG. 3. Adhesive, brazing, electric heat welding, and ultrasonic welding (not shown) can be employed to rigidly secure the ends 304 and 306 of the hoop 302 to an associated base.

Base 308 of the staple shown in FIG. 12 has a stop 310 secured thereto to prevent removal of loop 302 from an associated base 26 in FIG. 1, 86 in FIG. 4, and 200 in FIG. 6 when the staple is secured in a fastened condition by an associated padlock L. Stop 310 is formed from a strip of material of the same thickness as base 308 which has been fixedly secured to an edge of the base 308 by suitable adhesive or welding (not shown). Base 308 can have a slippery surface such as wax or high gloss paint thereon (not shown) to facilitate removal from said staple from an associated staple mount when the closure fastener is in an unlocked condition. Base 308 can have a friction surface thereon such as ribbed rubber or sandpaper (not shown) to retain the staple in a desired position relative to an associated staple mount to facilitate use thereof by a handicapped person such as a one armed user.

Base 312 of the staple shown in FIG. 13 is joined to a parallel positioned base 313 of greater length than base 312 by a bend which forms a stop 314 to prevent removal of loop 302 of the staple base 313 from an associated staple mount when the closure fastener is in a closed locked condition. Base 313 has a surface which can have a smooth or a rough surface thereon for suitable engagement with an associated staple mount as described above in conjunction with the base 308 of the staple shown in FIG. 12.

It is to be understood that the present invention is not limited to the embodiments described above, but encompasses any and all embodiments within the scope of the following claims.

I claim:

1. A closure fastener, comprising a readily releasable hasp assembly including an elongated hasp having a pair of ends which are longitudinally spaced, there being an elongated slot in one of said ends, the other of said ends having a tongue secured thereto so as to be foldable thereunder, an elongated hasp mount having channel means for releasably receiving said tongue therein with said hasp folded thereover, said tongue having a length greater than said mount so that said hasp cannot be released from said mount when said fastener is in a closed condition; and a readily releasable staple assembly including: a staple to be received by said slot of said hasp when said fastener is in a closed condition, a staple mount having means for releasably receiving said staple when said fastener is in an open condition, whereby when said hasp mount and said staple mount are fixed to supporting surfaces, said hasp slidably engages said hasp mount, and said staple slidably engages said staple mount so as to be captively retained in engagement therewith upon closing said hasp and receiving said staple through said slot in a locked condition of said closure fastener, said hasp and said staple being readily and completely removable from said associated staple and hasp mounts when said closure fastener is in an unlocked condition with said hasp out of engagement with said staple to prevent a person from being injured by inadvertent contact with the hasp or the staple.

2. The closure fastener according to claim 1, wherein said tongue is attached to said hasp by a hinge connection, said hinge connection comprising a permanently mounted pintle pin extending through pintles integral with said tongue and said hasp.

3. The closure fastener according to claim 1, wherein said hasp mount and said staple mount each include oppositely disposed channels to cooperatively receive said hasp and said staple.

4. The closure fastener according to claim 3, wherein said hasp and said staple mounts each have fasteners extending therethrough to rigidly secure said mounts to an associated door and door frame of a cabinet to be closed by said closure fastener and wherein, said fasteners are completely covered by associated portions of said mounts, said hasp, and said staple when the closure fastener is in closed locked condition so that the fasteners are hidden from view and thus cannot be readily engaged by a tool of a thief to remove the fasteners and the associated hasp and staple and thus compromise the closed condition of said cabinet.

5. The closure fastener according to claim 1, wherein said hasp mount and said staple mount each include a planar panel having inwardly directed folds along opposing sides of said panel, and oppositely disposed channels bounded by said folds, whereby said channels cooperatively receive said hasp and said staple, said hasp mount and said staple mount each include fastening means for rigidly attaching said mounts to a supporting surface, said mounts each having openings in said planar panels thereof to receive said fastening means therethrough to rigidly fasten said mounts to an associated door and door frame a cabinet to be secured by said closure fastener.

6. A closure fastener as recited in claim 5, wherein said folds are spaced from each other to form an opening of sufficient size to allow a tool to be inserted thereinto to securely tighten said fasteners to said door and said door frame.

7. The closure fastener according to claim 1, further including a plurality of threadable fasteners with concave heads and wherein said hasp mount and said staple mount each include a plurality of countersunk concave bores for flushly receiving said heads of said plurality of fasteners for rigidly attaching said mounts to a supporting surface.

8. The closure fastener according to claim 1, wherein said hasp further includes a tongue having a hook, and wherein said hasp mount includes means for biasing said hook into engagement with said hasp mount, whereby said tongue slidably engages said mount until said hook catches a terminal end of said hasp mount, retaining said tongue in engagement with said hasp mount, and, upon applying a force applied against said biasing means, said hook is enabled to disengage from said terminal end of said hasp mount, thus permitting said tongue to be slidably released from said hasp mount.

9. The closure fastener according to claim 1, wherein said staple further includes a base having a hook, and wherein said staple mount includes means for biasing said hook into engagement with said staple mount, whereby said base slidably engages said staple mount and is moved therealong until said hook catches a terminal end of said staple mount, thus retaining said base in engagement with said staple mount, and, upon applying a force against said biasing means, said hook is enabled to disengage from said terminal end of said staple mount, thereby permitting said base to be slidably released from said staple mount.

10. The closure fastener according to claim 9, wherein said staple mount further includes a stop extending beyond said terminal end of said staple mount, whereby travel of said base relative to said staple mount is limited by said stop.

11. The closure fastener according to claim 9, wherein said hasp further includes a tongue having a hook, and wherein said hasp mount includes means for biasing said hook into engagement with said hasp mount, whereby said tongue slidably engages said hasp mount and is moved therealong until said hook catches a terminal end of said hasp mount, thus retaining said tongue in engagement with said hasp mount, and, upon applying a force against said biasing means, said hook is enabled to disengage from said terminal end of said hasp mount, thereby permitting said tongue to be slidably released from said hasp mount.

12. The closure fastener according to claim 11, wherein said hasp mount further includes a stop extending beyond said terminal end of said hasp mount, whereby travel of said tongue relative to said hasp mount is limited by said stop.

13. The closure fastener according to claim 1, wherein said staple mount further includes a laterally extending member for facilitating in limiting travel of said staple therethrough.

14. The closure fastener according to claim 1, wherein said hasp mount further includes a laterally extending member for facilitating in limiting travel of said hasp therethrough.

15. The closure fastener according to claim 1, wherein said staple assembly comprises a stiff generally U-shaped wire fixedly secured to a staple base, said staple base having means thereon providing a stop to prevent said base from being removed from said staple mount when said closure fastener is fastened by a padlock.

16. A universal mount for both a hasp and a staple of a closure fastener formed from a zigzag shaped piece of bendable sheet metal which has score lines thereon to indicate both weakened portions which are to be bent to form the universal mount and weakened portions which are to be punched out to provide openings in the mount, said mount comprising an elongated central portion having opposed laterally extending sides and opposed longitudinally extending sides, said laterally extending sides each having an integral tab extending longitudinally therefrom, said tabs each extending in opposite directions in a staggered manner, said tabs each having a longitudinal dimension which is slightly less than the longitudinal dimension of said central portion, said tabs each having a lateral dimension which is slightly less than half the lateral dimension of said central portion, said tabs each being bendable away from and toward said central portion so as to overlie a portion thereof and form therewith and with each other a channel of substantially closed configuration, said channel extending laterally and being adapted to slidably receive therein a base portion of a staple or a hasp of said closure fastener, each of said tabs having means for fastening said tabs to a door or a door frame of an associated cabinet.

17. A universal mount as recited in claim 16, wherein said mount tabs each have an opening therein to receive a fastener, said central portion having openings therein opposed to said openings in said tabs of sufficient size to accommodate a tool therein to fasten said fasteners, said tabs having sufficient flexibility so that said base can be securely mounted on a surface of a door or a door jamb even if said surface has slight irregularities thereon, said piece or bendable sheet metal having sufficient rigidity to resist breakage thereof by a thief while attempting to forcibly open said closure fastener.

18. A staple for a closure fastener formed from a U-shaped piece of sheet metal having score lines thereon to indicate where the metal piece is to be folded and to indicate where the metal piece is to be punched to form openings for reception of a shackle of a padlock therethrough, said piece of metal having a base portion which has opposed horizontally extending sides joined by spaced vertically extending sides, said base portion having tabs which extend laterally therefrom a distance more than twice the lateral extent of said base portion so that when folded said tabs will form opposed leg portions of unequal length integrally joined to each other by a curved U-shaped bight portion which will act as a stop to prevent the said staple from being slid completely through an associated channel of a mount to which the staple is attached when part of a closure fastener, said base portion being bent vertically along a medially disposed score line to form a pair of opposed integrally joined L-shaped portions, said base portion having opposed openings therein of sufficient size to receive a shank of a padlock therein when said staple is used with a hasp as a closure fastener, the longer leg portions of each of said unequal length leg portions acting as a base of said staple which is slidable along an associated channel of an associated mount, said staple base having sufficient length so that the staple cannot be slid out of engagement with said channel when secured thereto as part of said closure fastener.

19. A staple as recited in claim 18, wherein said longer leg portions are biased slightly away from each other so that said base will frictionally engage said channel of said mount to retain said staple at a selected position within said channel so that said staple can be readily engaged within an opening formed in an associated hasp of said closure fastener.

20. A staple as recited in claim 19, wherein said longer leg portions resiliently move towards each other to accommodate entry into a staple mount which has a slightly undersized channel.

* * * * *